US008628125B2

(12) United States Patent
Huang et al.

(10) Patent No.: US 8,628,125 B2
(45) Date of Patent: Jan. 14, 2014

(54) LOCK STRUCTURE

(75) Inventors: Lien-Hsi Huang, Kaohsiung (TW); Kuang-Chun Chiang, Kaohsiung County (TW)

(73) Assignee: Taiwan Fu Hsing Industrial Co., Ltd., Kang Shan Town, Kaohsiung County (TW)

( * ) Notice: Subject to any disclaimer, the term of this patent is extended or adjusted under 35 U.S.C. 154(b) by 0 days.

(21) Appl. No.: 13/604,393

(22) Filed: Sep. 5, 2012

(65) Prior Publication Data

US 2012/0326455 A1 Dec. 27, 2012

Related U.S. Application Data

(63) Continuation of application No. 12/703,283, filed on Feb. 10, 2010, now abandoned.

(51) Int. Cl.
*E05C 1/06* (2006.01)
*E05C 1/00* (2006.01)

(52) U.S. Cl.
USPC ..... 292/142; 292/32; 292/34; 292/92; 292/279

(58) Field of Classification Search
USPC ..... 292/32–34, 36, 37, 39, 42, 51, 92–94, 292/137–143, 145, 279, 280
See application file for complete search history.

(56) References Cited

U.S. PATENT DOCUMENTS

| | | | | |
|---|---|---|---|---|
| 519,687 | A | 5/1894 | Johnston | |
| 932,330 | A | 8/1909 | Rotchford | |
| 1,006,211 | A | 10/1911 | Hermon | |
| 1,380,117 | A | 5/1921 | Solaini | |
| 1,504,176 | A | 8/1924 | Wright | |
| 1,633,173 | A | 6/1927 | Freedman et al. | |
| 1,900,503 | A | 3/1933 | Kemp | |
| 2,147,581 | A | 2/1939 | Prinzler | |
| 4,227,723 | A | 10/1980 | Rosell | |
| 4,384,465 | A | 5/1983 | Muus | |
| 4,387,917 | A | 6/1983 | Cocker | |
| 4,427,223 | A | 1/1984 | Godec et al. | |
| 4,476,700 | A | 10/1984 | King | |
| 5,094,483 | A | 3/1992 | James | |
| 5,169,185 | A | 12/1992 | Slaybaugh et al. | |
| 5,404,737 | A | 4/1995 | Hotzl | |
| 5,890,753 | A | 4/1999 | Fuller | |
| 6,000,733 | A | 12/1999 | Linder | |
| 6,030,019 | A | 2/2000 | Stiltner et al. | |
| 6,217,087 | B1 | 4/2001 | Fuller | |
| 6,945,571 | B2 | 9/2005 | Lin | |
| 6,953,211 | B2 | 10/2005 | Di Vinadio | |
| 6,971,686 | B2 | 12/2005 | Becken | |
| 7,455,333 | B2 * | 11/2008 | Ookawara | 292/34 |
| 7,731,248 | B2 | 6/2010 | Balbo Di Vinadio | |
| 7,753,418 | B2 | 7/2010 | Fleming | |

FOREIGN PATENT DOCUMENTS

| | | | |
|---|---|---|---|
| EP | 21820 | A1 | 1/1981 |

* cited by examiner

*Primary Examiner* — Carlos Lugo
(74) *Attorney, Agent, or Firm* — Muncy, Geissler, Olds & Lowe, PLLC

(57) ABSTRACT

A lock structure with at least one latch comprises a base, a link member, a sliding member and a rotating member. The link member is moveable relative to the base to drive the latch. The sliding member is engaged with the link member and being capable of driving the link member. The rotating member is rotatably disposed between the base and the sliding member, wherein the rotating member is capable of driving the sliding member and the link member to drive the latch.

15 Claims, 8 Drawing Sheets

LOCK STRUCTURE

CROSS REFERENCE TO RELATED APPLICATIONS

This application is a continuation application of U.S. patent application Ser. No. 12/703,283, filed on Feb. 10, 2010 now abandoned, the benefits of which are claimed under 35 U.S.C. §120, and entire contents of which are hereby incorporated by reference.

FIELD OF THE INVENTION

The present invention is generally relating to a lock structure, more particularly to a lock structure of exit device.

BACKGROUND OF THE INVENTION

The known exit device uses a lock structure to control the unlocking and locking actions of the top and bottom latches. However, when the exit device is installed on the left-handed door from the right-handed door or otherwise due to change a design of building space or other safety considerations, an unlock rotation direction of the lock structure will be changed because of the lock structure of the known exit device only can unlock in single rotation direction, which will result persecution and inconvenience in operation for users. In order to overcome above problems, general users almost replace the lock structure with a new one and an additional outlay for replacing the lock structure will be needed.

SUMMARY

The primary object of the present invention is to provide a lock structure with at least one latch comprising a base, a movable assembly, a rotating member and a driving member. The base has a bottom surface, a first recession located at the bottom surface and a second recession in communication with the first recession. The movable assembly comprises a link member being moveable relative to the base and a sliding member capable of driving the link member, wherein the sliding member has a first opening and a second opening opposite to the first opening. The rotating member is disposed within the first recession of the base and has a first surface facing the sliding member, a first protrusion formed on the first surface and a second protrusion disposed opposite to the first protrusion, wherein the first protrusion and the second protrusion engage with the first opening and the second opening respectively. The driving member is disposed within the second recession of the base and engages with the rotating member. In present invention, the driving member is capable of driving the rotating member via clockwise rotation and enables the first protrusion of the rotating member to push the sliding member and move the link member thereby unlocking the latches, otherwise, the driving member is also capable of driving the rotating member via counterclockwise rotation and enables the second protrusion of the rotating member to push the sliding member and move the link member thereby unlocking the latches. Therefore, after the exit device is installed on the right-handed door from the left-handed door or otherwise, an unlock rotation direction of the driving member can be maintained without change, so it is good for users and an additional outlay for replacing the lock structure will be saved.

DETAILED DESCRIPTION OF THE INVENTION

Figure 1:
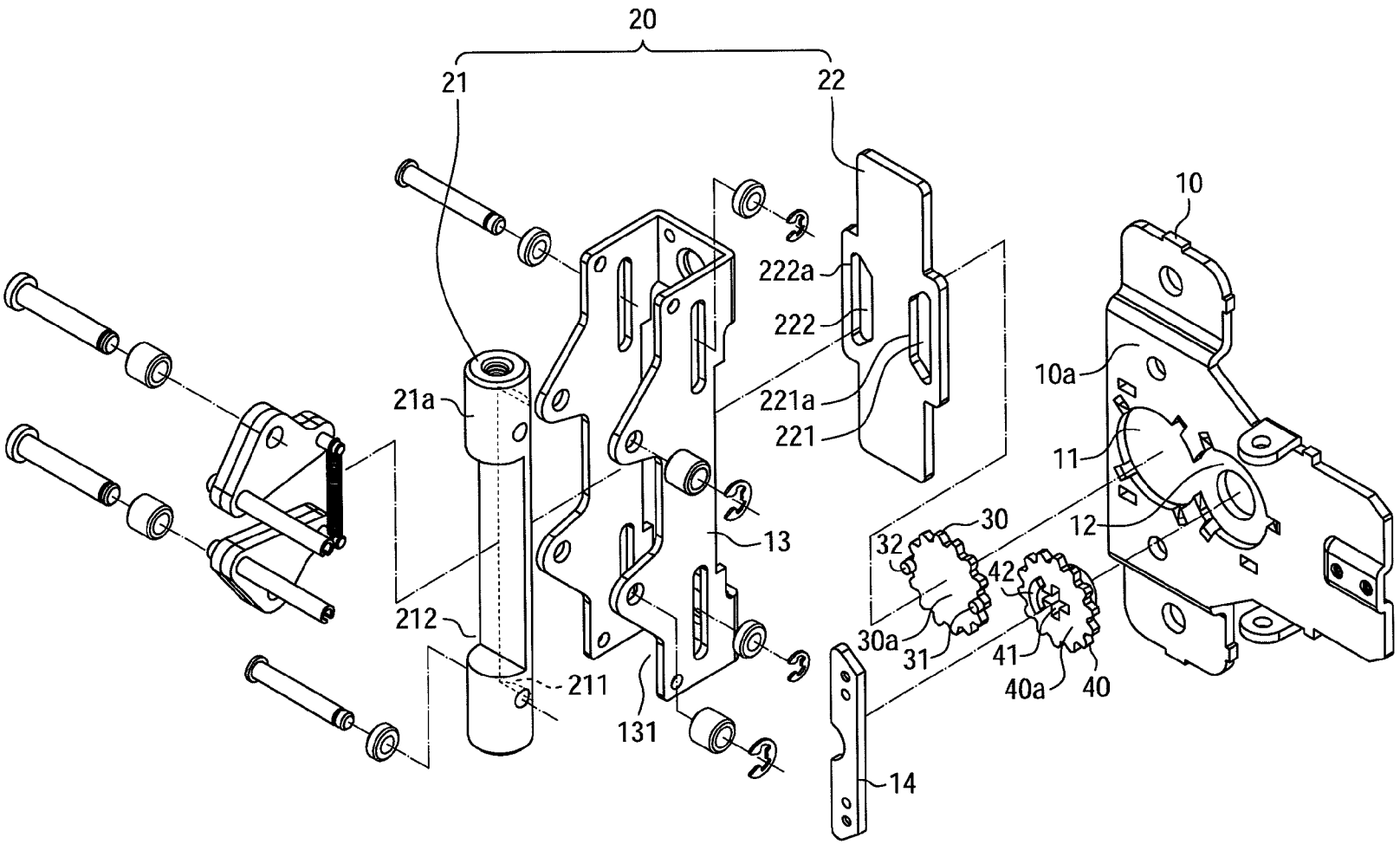
FIG. 1 is an exploded perspective view illustrating a lock structure in accordance with a preferred embodiment of the present invention.
Figure 2:
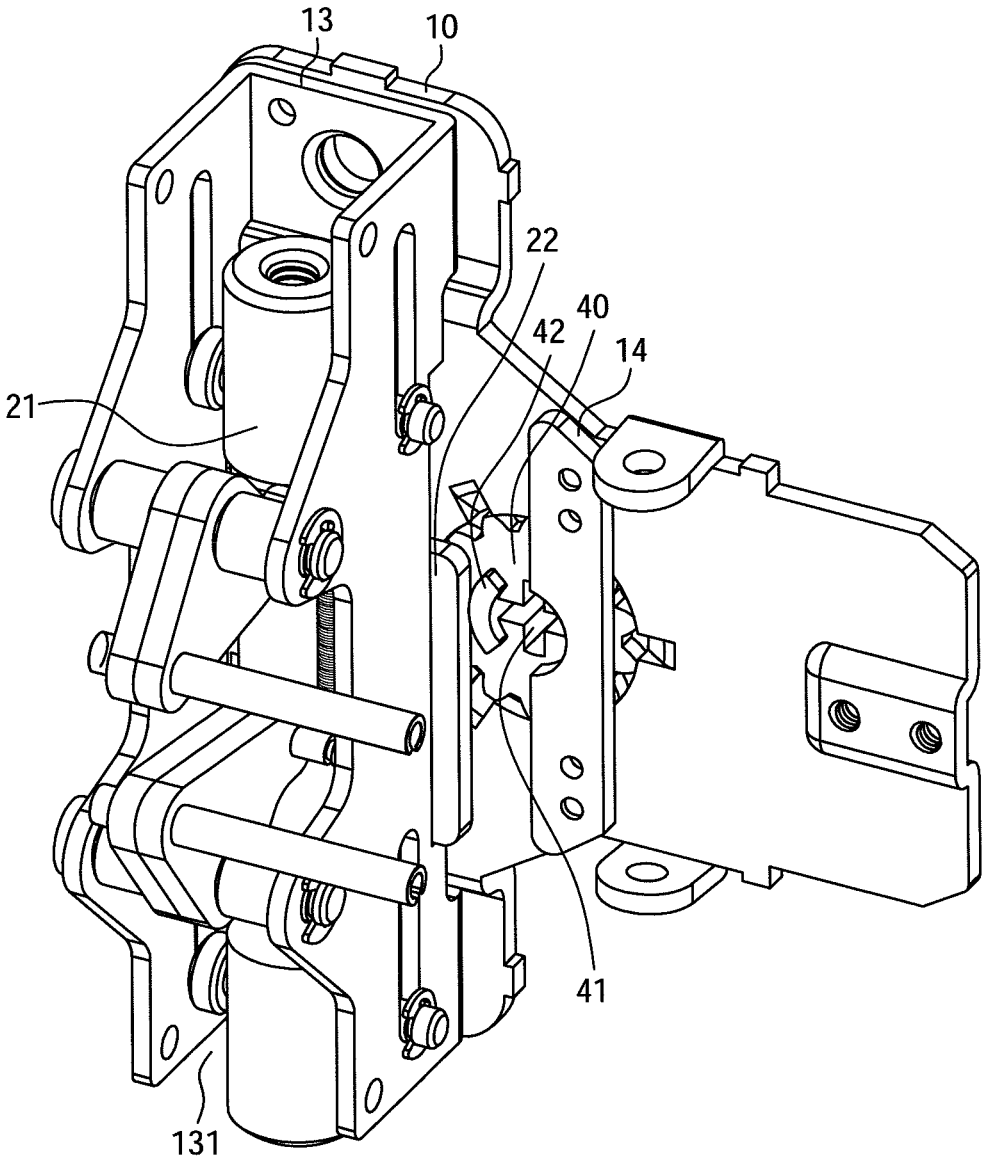
FIG. 2 is an assembled perspective view illustrating the lock structure.
Figure 3:
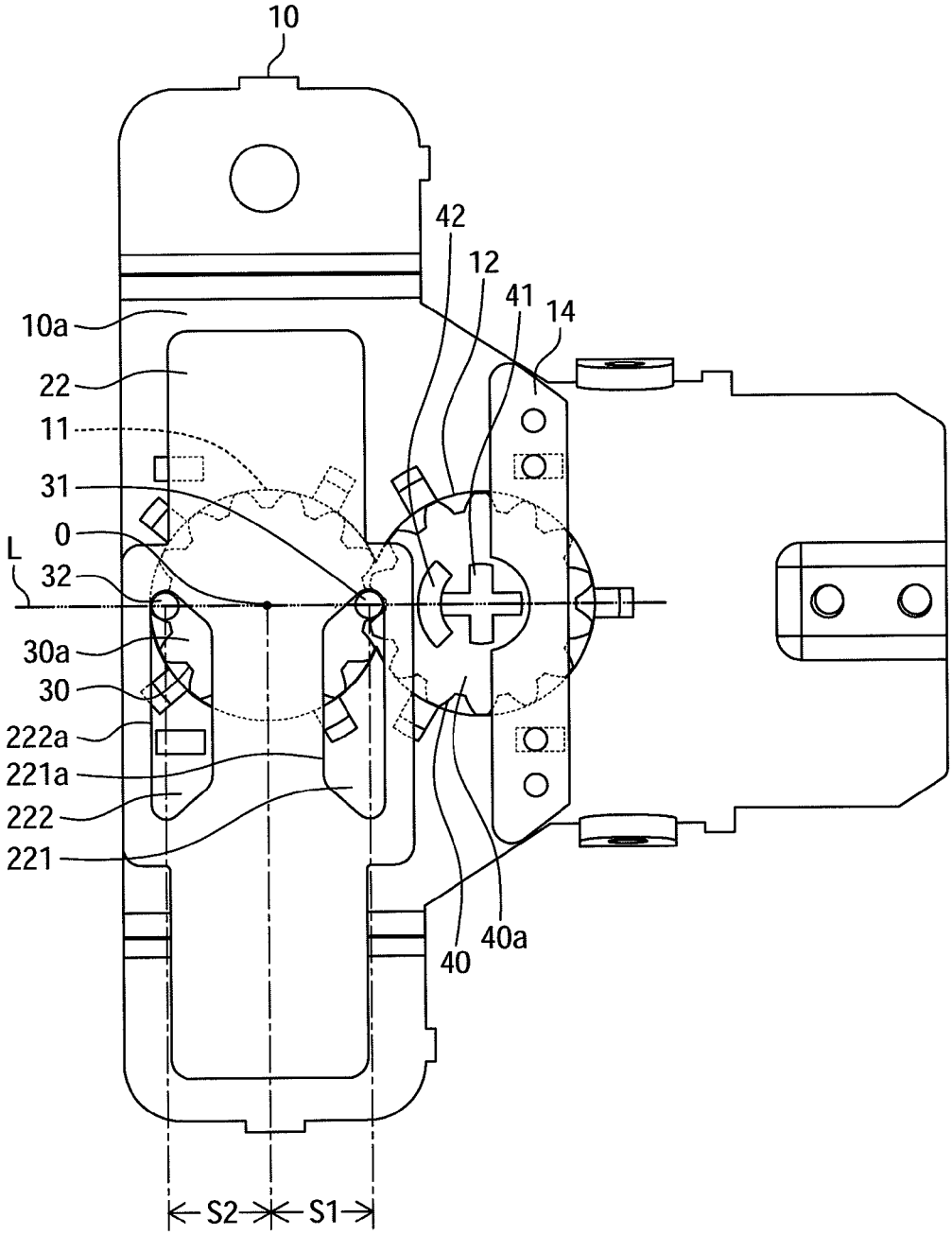
FIG. 3 is a side view illustrating a portion of the lock structure.
Figure 6:
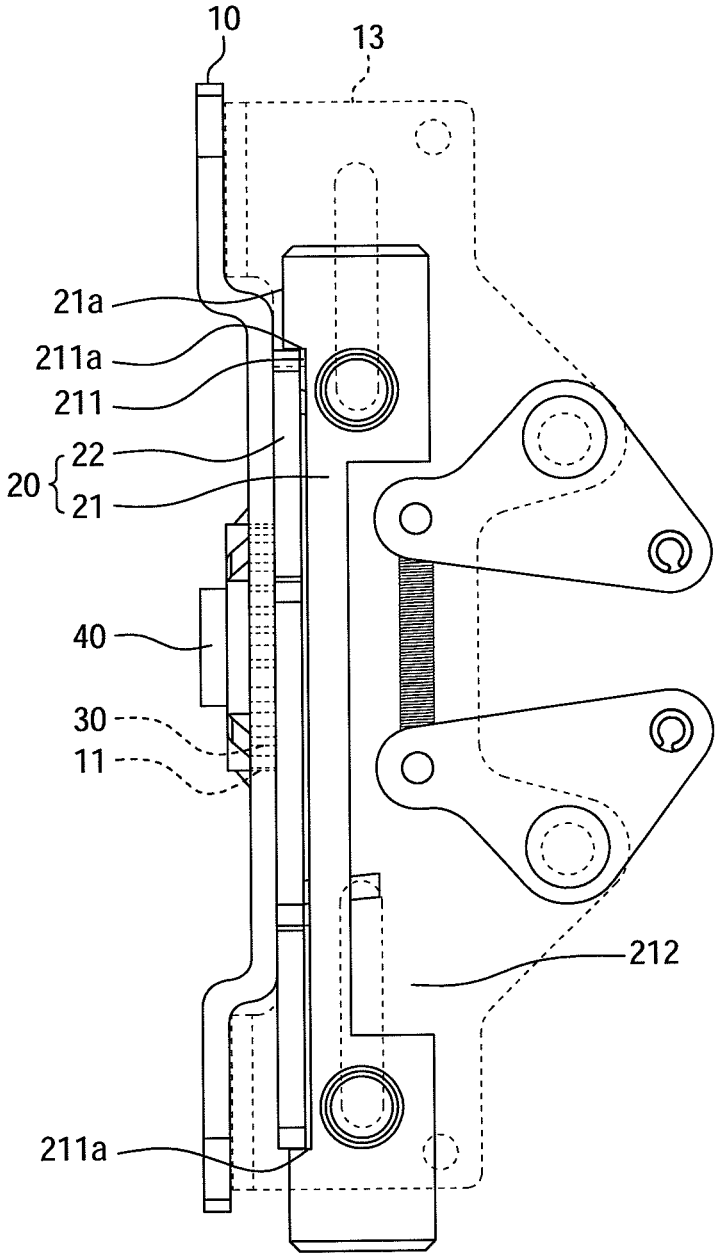
FIG. 6 is a side view illustrating the lock structure.

With reference to FIGS. 1, 2 and 3, a lock structure in accordance with a preferred embodiment of the present invention comprises a base 10, a movable assembly 20, a rotating member 30 and a driving member 40. The base 10 has a bottom surface 10*a*, a first recession 11 located at the bottom surface 10*a*, a second recession 12 located at the bottom surface 10*a*, a supporting portion 13 disposed above the first recession 11 and a limiting component 14 located above the second recession 12. In this embodiment, the first recession 11 and the second recession 12 are recessed from the bottom surface 10*a*, wherein the first recession 11 is in communication with the second recession 12 and the supporting portion 13 has an accommodating space 131. The movable assembly 20 comprises a link member 21 being moveable relative to the base 10 and a sliding member 22 capable of driving the link member 21. Referring to FIGS. 1, 2 and 6, the link member 21 is pivotally disposed within the accommodating space 131 of the supporting portion 13 and has an outside wall 21*a*, an accommodating area 211 recessed form the outside wall 21*a* and a concave 212 opposite to the accommodating area 211, besides the accommodating area 211 has at least one abutting surface 211*a*. The sliding member 22 is disposed into the accommodating area 211 of the link member 21 and located between the link member 21 and the rotating member 30, preferably the sliding member 22 contacts against the abutting surface 211*a* of the accommodating area 211 to engage with the link member 21. The sliding member 22 has a first opening 221 and a second opening 222 opposite to the first opening 221, wherein the first opening 221 has an inner wall 221*a* and the second opening 222 has an inner wall 222*a*.

Referring to FIGS. 1, 2 and 3 again, the rotating member 30 is rotatably disposed at the first recession 11 of the base 10 and located between the base 10 and the sliding member 22. The rotating member 30 has a center O, a first surface 30*a* facing the sliding member 22, a first protrusion 31 formed on the first surface 30*a* and a second protrusion 32 disposed opposite to the first protrusion 31, the first protrusion 31 and the second protrusion 32 engage with the first opening 221 and the second opening 222 of the sliding member 22 respectively. Preferably, the first protrusion 31 and the second protrusion 32 are capable of contacting against the inner wall 221*a* of the first opening 221 and the inner wall 222*a* of the second opening 222 respectively for driving the sliding member 22. In this embodiment, the center O, the first protrusion 31 and the second protrusion 32 are located on a same straight line L, wherein there is a first gap S1 between the first protrusion 31 and the center O and there is a second gap S2 between the second protrusion 32 and the center O, preferably the second gap S2 is equal to the first gap S1 that allows the first protrusion 31 and the second protrusion 32 to drive the sliding member 22 with same acting moments. Referring to FIGS. 1, 2 and 3 again, the driving member 40 is rotatably disposed within the second recession 12 of the base 10 and capable of driving the rotating member 30 via a chain, a transmission gear, directly engaging with the rotating member 30 or other driving methods. In this embodiment, the driving member 40 and the rotating member 30 are gears, preferably the driving member 40 is capable of engaging with the rotating member 30 and driving it. Besides, the driving member 40 has a second surface 40*a* facing the limiting component 14, a central cross hole 41 and a limiting protrusion 42 formed on the second surface 40*a* and at one side of the central cross hole 41, preferably the limiting protrusion 42 is in shape of arc, and furthermore the limiting protrusion 42 is capable of selectively contacting against the limiting component 14 of the base 10 to limit a rotation angle of the driving member 40.

Figure 4A:
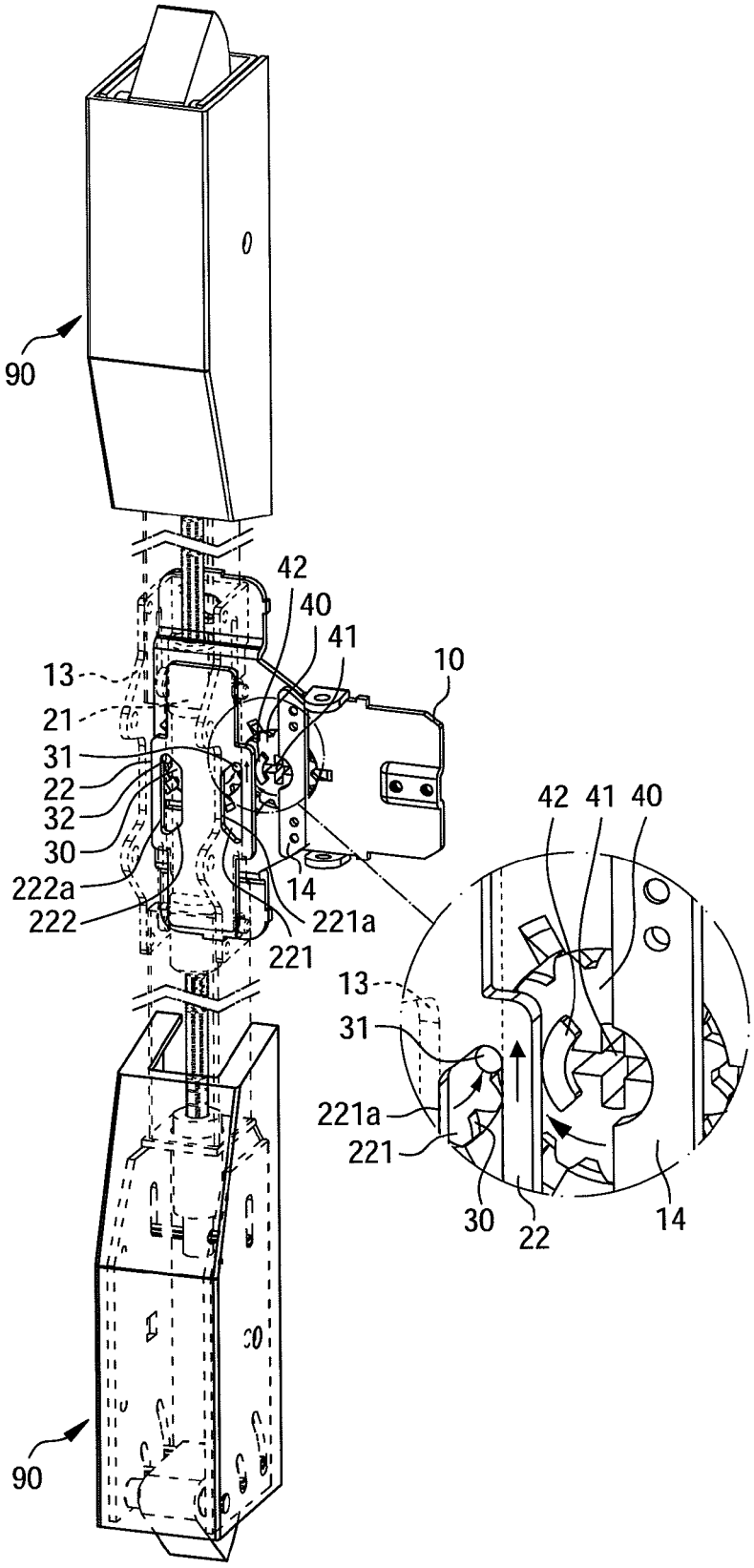
FIG. 4A-4B is an action view of the lock structure installed on the right-handed door.
Figure 4B:
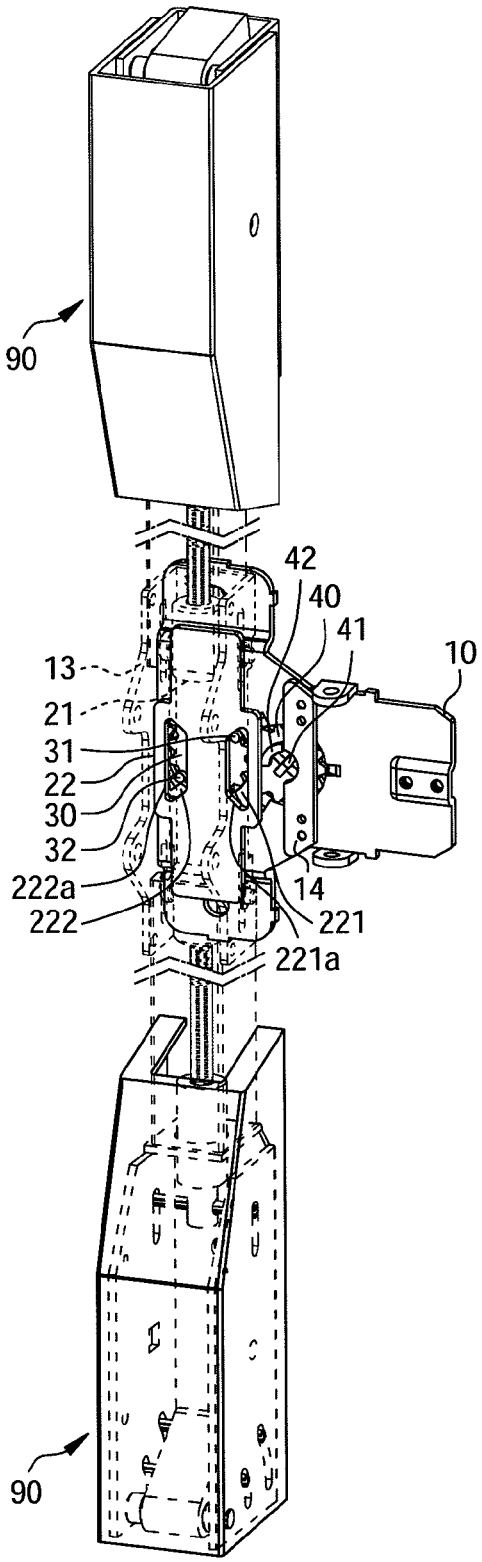

With reference to FIGS. 4A and 4B, an action about the lock structure installed on the right-handed door is shown. First, FIG. 4A shows the lock structure installed on the right-handed door in locking state, in which the first protrusion 31 and the second protrusion 32 of the rotating member 30 contact against the inner wall 221*a* of the first opening 221 and the inner wall 222*a* of the second opening 222 respectively. Besides, the link member 21 is connected with the top and bottom latches 90. With reference to FIGS. 4A and 4B, when an unlocking step needs to be performed, it is capable of using a key or a handle (not shown in the drawings) to drive the driving member 40 in clockwise rotation and drive the rotating member 30 in counterclockwise rotation, and meantime the first protrusion 31 of the rotating member 30 pushes the inner wall 221*a* of the first opening 221 to move the sliding member 22 and drive the link member 21 to move upward thereby unlocking the top and bottom latches 90. In this embodiment, when the driving member 40 is rotated to a suitable angle, the limiting protrusion 42 of the driving member 40 contacts against the limiting component 14 of the base 10 to limit the rotation angle of the driving member 40.

Figure 5A:
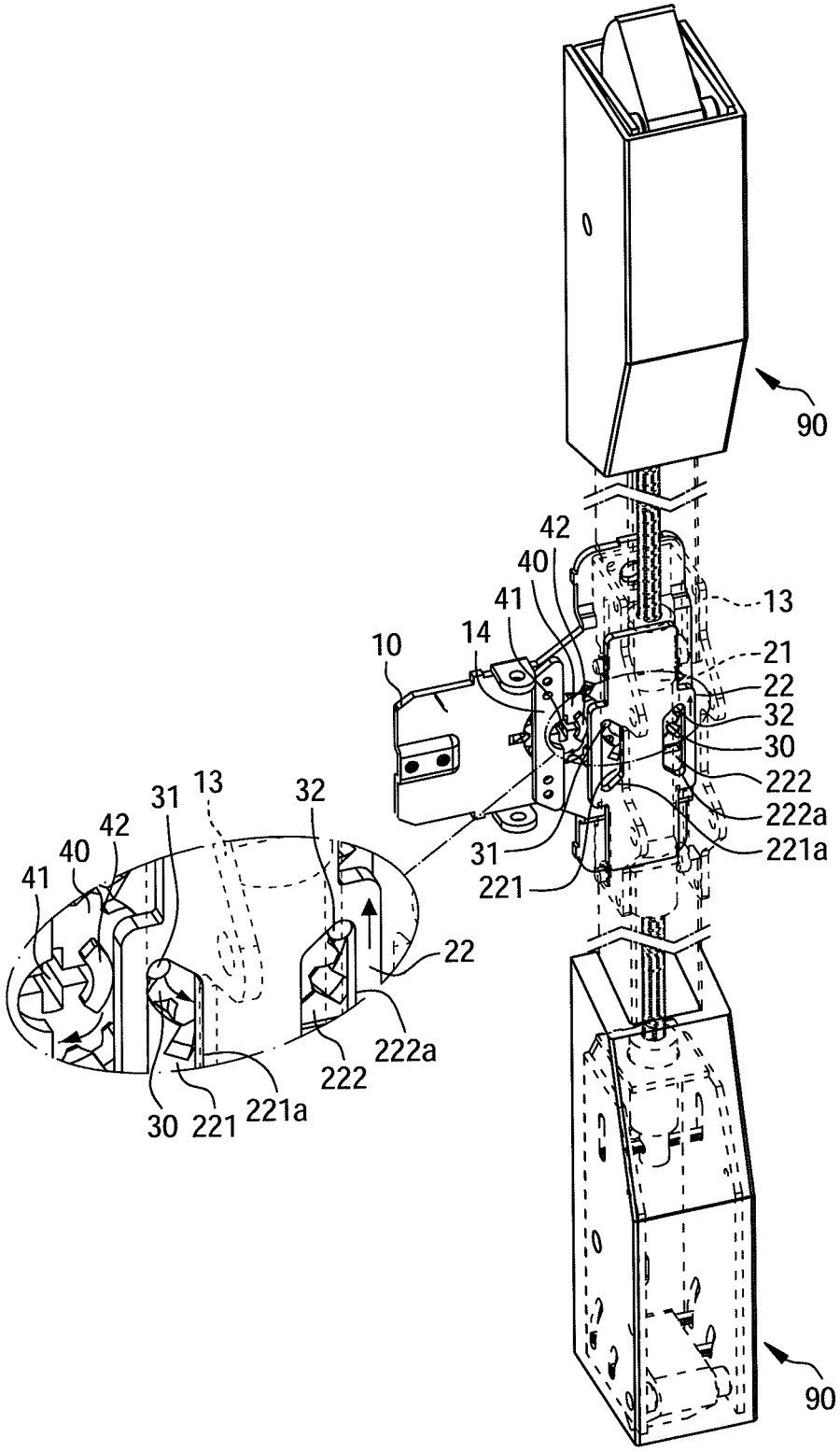
FIG. 5A-5B is an action view of the lock structure installed on the left-handed door.
Figure 5B:
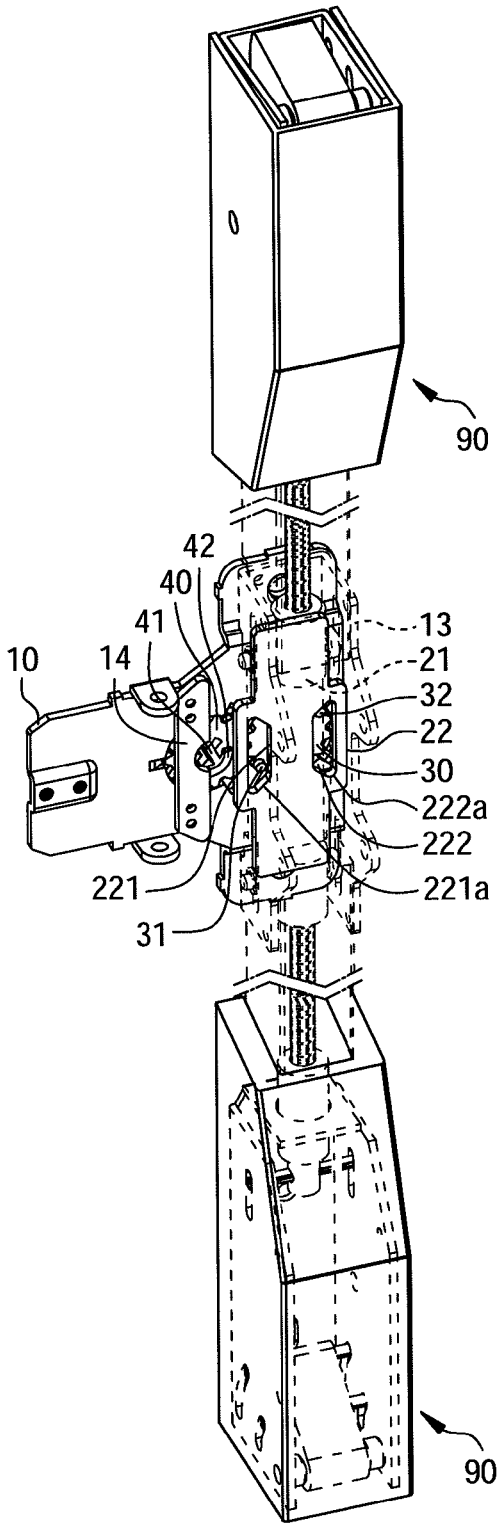

With reference to FIGS. 5A and 5B, an action about the lock structure installed on the left-handed door is shown. First, FIG. 5A shows the lock structure installed on the left-handed door in locking state, in which the first protrusion 31 and the second protrusion 32 of the rotating member 30 contact against the inner wall 221*a* of the first opening 221 and the inner wall 222*a* of the second opening 222 respectively. Besides, the link member 21 is connected with the top and bottom latches 90. With reference to FIGS. 5A and 5B, when an unlocking step needs to be performed, it is capable of using a key or a handle (not shown in the drawings) to drive the driving member 40 in clockwise rotation and drive the rotating member 30 in counterclockwise rotation, and meantime the second protrusion 32 of the rotating member 30 pushes the inner wall 222*a* of the second opening 222 to move the sliding member 22 and drive the link member 21 to move upward thereby unlocking the top and bottom latches 90. In this embodiment, because of the driving member 40 is capable of driving the rotating member 30 via clockwise rotation or counterclockwise rotation, so no matter what the exit device is installed on the left-handed or right-handed door, the unlock rotation direction of the driving member 40 can be maintained without change, so it is good for users and an additional outlay for replacing the lock structure will be saved.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A lock structure comprising a latch mechanism, a drive mechanism and a base, wherein the latch mechanism is configured to lock or unlock along a longitudinal axis, the drive mechanism includes a driving member, a rotating member, and a sliding member, wherein the driving member and the rotating member are engaged mutually, the driving member is driven along an unlock direction in response to a force exerted manually, and the sliding member is moved along the longitude axis to drive the latch mechanism to unlock by the rotation of the rotating member which is driven by the driving member, and the driving member is selectively mounted at a first position which is not aligned with the longitudinal axis or a second position which is opposite to the first position, wherein the unlock direction of the driving member is the same whether the driving member is mounted at the first position or at the second position, and the driving member is rotatable until a first feature of the driving member is engaged with a second feature of the base so that the rotation angle of the driving member is limited, wherein the driving member is mounted or the base, the base having a bottom surface, a first recession recessed from the bottom surface and a second recession recessed from the bottom surface, the first recession and the second recession are intercommunicated with each other, the rotating member and the driving member are disposed within the first recession and the second recession respectively, and, when the lock structure is mounted at a left handed position of a door, the base is mounted at the first position; and when the lock structure is mounted at a right handed position of the door, the base is mounted at the second position.

2. The lock structure in accordance with claim 1, wherein the rotating member and the sliding member are located across the longitude axis.

3. The lock structure in accordance with claim 1, wherein the base is selectively mounted at two alternatively mirror positions such that the driving member is mounted at the first position or at the second position.

4. The lock structure in accordance with claim 3, wherein the base is a T-shaped plate.

5. The lock structure in accordance with claim 1, wherein the latch mechanism comprises a latch and a link member coupled to the latch, the sliding member engages with and drives the link member, and the link member is movable relative to the base.

6. The lock structure in accordance with claim 5, wherein the rotating member is rotatably disposed between the sliding member and the link member.

7. The lock structure in accordance with claim 5, wherein the link member has a concave and an accommodating area, the sliding member is disposed into the accommodating area.

8. The lock structure in accordance with claim 7, wherein the accommodating area of the link member has at least one abutting surface, the sliding member contacts against the abutting surface.

9. The lock structure in accordance with claim 1, wherein the rotating member has a first surface facing toward the sliding member, a second surface opposite to the first surface and a first protrusion formed on the first surface, the second surface faces toward the base, the sliding member has a first opening, and the first protrusion is engaged with the first opening of the sliding member.

10. The lock structure in accordance with claim 9, wherein the sliding member further comprises a second opening opposite to the first opening, the rotating member further comprises a second protrusion formed on the first surface, and the second protrusion is engaged with the second opening of the sliding member.

11. The lock structure in accordance with claim 10, wherein the rotating member has a center, the center, the first protrusion and the second protrusion are located on a same straight line.

12. The lock structure in accordance with claim 11, wherein there is a first gap between the first protrusion and the center, and there is a second gap between the second protrusion and the center, the second gap is equal to the first gap.

13. The lock structure in accordance with claim 9, wherein the driving member engages with the rotating member.

14. The lock structure in accordance with claim 13, wherein the rotating member and the driving member are gears.

15. The lock structure in accordance with claim 1, wherein the second feature of the base is a limiting component located above the second recession, the first feature of the driving member is a limiting protrusion selectively contacted against the limiting component of the base.

* * * * *